United States Patent [19]

Elliott

[11] 4,151,956

[45] May 1, 1979

[54] COMBINATION TOOL AND ROTARY HEAD SPRINKLER APPARATUS

[75] Inventor: Frederick T. Elliott, Winter Garden, Fla.

[73] Assignee: Senninger Irrigation, Inc., Orlando, Fla.

[21] Appl. No.: 657,500

[22] Filed: Feb. 12, 1976

[51] Int. Cl.[2] ..... B05B 3/14

[52] U.S. Cl. ..... 239/230; 239/289; 7/138

[58] Field of Search ..... 81/1, 53, 180, 71; 7/1 G, 7, 1 E, 71, 1 R; 239/230, 231, 289, 580

[56] References Cited

U.S. PATENT DOCUMENTS

| | | | |
|---|---|---|---|
| 624,282 | 5/1899 | Wyler | 7/1 R |
| 2,106,749 | 2/1968 | Knight | 81/180 R |
| 2,448,168 | 8/1948 | Banister | 81/71 |
| 2,596,383 | 5/1952 | Dunham | 239/230 |
| 2,625,411 | 1/1953 | Unger | 239/233 X |
| 2,992,574 | 7/1961 | Martinmaas | 81/3.46 A |
| 3,009,650 | 11/1961 | Alvarez | 239/230 |
| 3,204,873 | 9/1965 | Senninger | 239/230 |
| 3,669,356 | 6/1972 | Senninger | 239/230 |

*Primary Examiner*—John J. Love

*Attorney, Agent, or Firm*—Duckworth, Hobby, Allen & Pettis

[57] ABSTRACT

An improved rotary head sprinkler having a self-contained tool attached thereto for facilitating the assembly or the disassembly of a similar rotary head sprinkler. In a first embodiment of the invention a wrench or tool is attached to a sprinkler for coupling with a portion of a spindle cavity for enabling a rotary force to be exerted on the spindle coaxial with the longitudinal axis thereof, whereby the first end of the spindle may be coupled or decoupled from the sprinkler body. The wrench may also be used for coupling with other removable portions of another rotary sprinkler head. The wrench is attached adjacent a distended end of an impulse arm of the sprinkler head for increasing the oscillating period thereof.

17 Claims, 4 Drawing Figures

COMBINATION TOOL AND ROTARY HEAD SPRINKLER APPARATUS

BACKGROUND OF THE INVENTION

1. Field of the Invention

This invention relates to sprinklers and more particularly to sprinkler heads having self-contained tools attached thereto for facilitating the assembly or disassembly of a similar rotary head sprinkler.

2. Description of the Prior Art

Rotary sprinklers, especially the impulse type step-by-step rotary sprinklers have become a common and necessary implement for providing man-made irrigation for citrus groves and other agricultural crops. In citrus tree groves the sprinkler heads are normally carried on pipes rising to a high elevation above the trees. Due to normal weather cycles the utilization of these rotary sprinklers is quite sporadic. During the rainy season the sprinklers are seldom used, while during the dry season the sprinklers are utilized almost continuously. During the periods of infrequent use, it is often desirable to inspect and repair any defective sprinklers which may provide problems at a subsequent time. Also, during periods of heavy utilization the sprinklers have a higher probability of failing due to the heavy use. When such a failure occurs, the failed unit must be promptly replaced. It is therefore highly desirable to provide a rotary sprinkler head having a large mean time between failure (mtbf), and furthermore to provide a rotary sprinkler head which may be easily disassembled, repaired and then rapidly re-assembled and returned to irrigation service.

Prior art sprinklers have commonly utilized one of two common techniques to facilitate the rapid disassembly of the sprinkler head, which requires the removal of the spindle shaft as it communicates through the sprinkler swivel and into the sprinkler head. The first prior art method includes a hex-nut shaped coupling on the end of the spindle which protrudes into the riser pipe. This hex-nut shaped coupling is removed by the use of a spanner or closed end wrench. The second method utilized in the prior art is to include a transverse channel in the lower end of the spindle which then may be engaged by a large screw driver type blade. Both of these prior art methods require that the lower end of the sprinkler spindle be extended a considerable distance beyond the sealing washers and wear washers which are coupled between the end of the spindle and the swivel. This extension of the first end of the sprinkler spindle is required to produce a sufficiently strong spindle structure, while at the same time providing a sufficient clearance between the coupling means and the sealing and wear washer assemblies. Costa et al in U.S. Pat. No. 3,764,073 discloses a rotary sprinkler head utilizing a previously discussed transverse channel method of decoupling the spindle from the sprinkler head and the swivel assembly.

However, both of these previously described methods require a longitudinally extended spindle end for providing the necessary material to strengthen the coupling at the distended end thereof. This longitudinal extension protrudes into the riser pipe and, as shown in the Costa U.S. Pat. No. 3,764,073, severely reduces the clearance between the enlarged cavity at the distended end of the riser pipe and swivel. This reduced clearance allows dirt, mud, and other particulate matter suspended in the irrigation water to accumulate between the swivel and the riser pipe, thereby substantially increasing the probability of jamming the rotary motion of the spindle and therefore the rotary motion of the step-by-step spinkler head.

Other sprinkler head designs are disclosed by Senninger in U.S. Pat. No. 3,669,356 and the references contained therein.

SUMMARY OF THE INVENTION

The present invention relates to an improved sprinkler apparatus having a self-contained tool attached thereto for facilitating the assembly or disassembly of a similar sprinkler. In a first preferred embodiment, the tool is attached to a sprinkler head apparatus of the type having: a sprinkler body; a swivel having a bore therethrough and having attaching means for coupling to a source of water under pressure; a spindle rotatably coupled through the bore of the swivel, with the spindle having a water transport cavity communicating therethrough for enabling the flow of water from the source of water under pressure to the sprinkler body, with the spindle having a first end thereof for removably coupling to the sprinkler body, and a second end thereof for movably coupling with the swivel; a water discharge nozzle attached to the body thereof for discharging a stream of water therethrough; an impulse arm movably coupled to the sprinkler body, with the impulse arm having adjacent a first end thereof a water engaging portion for repelling the impulse arm from the stream of water upon engagement therewith; and resilient means coupled between said impulse arm and said sprinkler body for biasing the impulse arm for movement in one direction for engaging the stream of water being discharged by the nozzle. Tool means are attached to the impulse arm for increasing the mass thereof and for coupling with removable portions of another rotary head sprinkler for facilitating the assembly or disassembly thereof. In a first embodiment of the present invention the tool means comprises a wrench having the form of a shaft defined by a plurality of generally planar sides for coupling within a portion of the cavity of the spindle adjacent the second end thereof, with the cavity being defined by a plurality of generally planar sides for congruently coupling with the surfaces of the wrench when the shaft is inserted thereinto.

THE DRAWINGS

Other objects, features and advantages of this invention will be apparent from a study of the written description and the drawings in which.

DESCRIPTION OF THE PREFERRED EMBODIMENT

Figure 1:
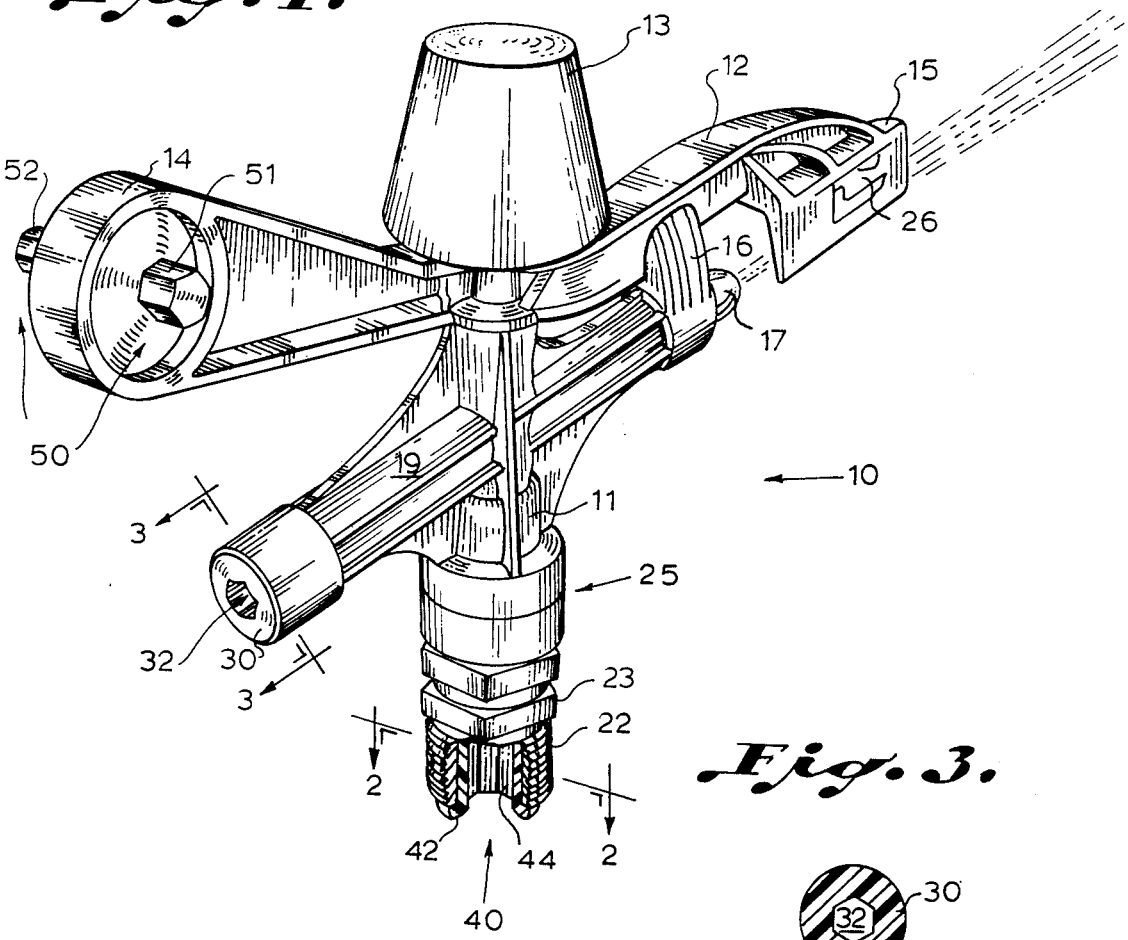
FIG. 1 illustrates a perspective view of the rotary head sprinkler assembly having the self-contained tool attached thereto.

An impulse arm step-by-step rotary irrigation sprinkler 10 is illustrated in FIG. 1. This rotary head sprinkler 10 is similar in most respects to the rotary sprinkler disclosed by Senninger in U.S. Pat. No. 3,669,356 and will be described only briefly herein. The rotary irrigation sprinkler 10 includes a sprinkler head body 11 with an impulse arm 12 which is operated by a spring located in a spring cover 13 which keeps the bearing and spring clean. A water engaging portion or spoon 15 is located at a first end of the impulse arm 12. A counterweight 14 is spaced from the water engaging portion 15 at a second end of the impulse arm 12 with the axis of pivotal motion for the impulse arm 12 located therebetween.

The sprinkler cylindrical housing 19 has a protruding member 16 for stopping the impulse arm 12 from proceeding past a certain point when the sprinkler is not in operation. The sprinkler body 11 includes a generally cylindrical housing 19 having a removable nozzle system 17 attached at one end thereof. The removable nozzle system 17 may be easily unscrewed from the cylindrical housing 19 for cleaning and replacement. A rear removable cover or cap 30 is coaxially coupled to the cylindrical housing 19 for providing access to the internal parts of the sprinkler assembly.

The water engaging surface 15 has at least one curved surface 26 adapted to engage the stream of water leaving the nozzle 17 in a manner such that the water impinging upon the surface 26 will force the impulse arm 12 against the spring and the cap 13 away from the water stream, while the spring will force or bias the impulse arm 12 and the surface 26 back toward the water stream. This impulse action results in an intermittent or stepped rotation of the sprinkler head body 11 about the rotatable connection 25.

Figure 4:
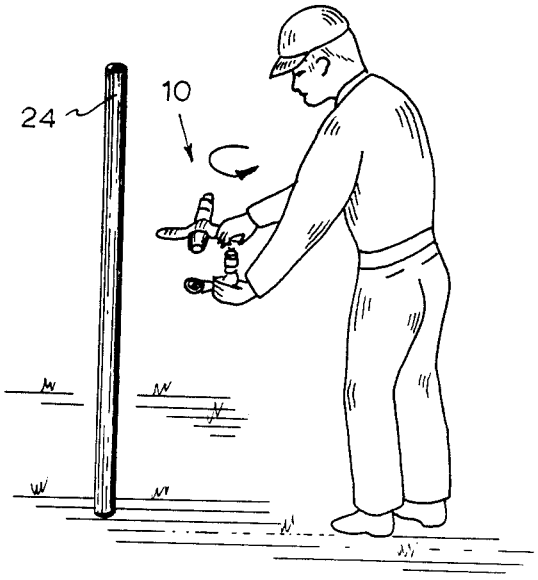
FIG. 4 is an illustration of the intended use of the combination rotary head sprinkler and tool.

The sprinkler 10 includes a swivel section 23 which couples to the body 11 at a rotatable connection 25. The swivel 23 includes a threaded section 22 at the distended end thereof to facilitate the easy insertion by threading into the riser pipe 24, shown in FIG. 4. The water under pressure supplied by the standpipe 24 is transported through a bore 40 (or water transport cavity) communicating longitudinally through a spindle 42 into the body 11 for subsequent escape through the nozzle 17. The spindle 42 coaxially communicates through a bore of the swivel 23 and couples at a first end thereof with said sprinkler body 11 by a plurality of threads. Thus, the swivel 23 which is coupled to the standpipe 24 allows the spindle 42 to rotate freely therewithin, thus allowing the body 11 of the sprinkler 10 to rotate about its axis. The lower portion of the bore 40 at the second end of the sprindle 42 is defined by a plurality of generally planar surfaces running generally parallel with the longitudinal axis of the spindle 42 for defining therein a generally hexagonal shaped cavity 44 (or nut). Of course, while a hexagonal cavity has been illustrated herein, a cavity having at least three sides would provide the required water transport passage while also providing the required torque transmitting surfaces. The hex shaped cavity 44 forms a continuous portion of the bore 40. The transition between the hex shaped cavity 44 and the bore 40 takes place within the spindle 42 (not shown). The details of the swivel 23 and the spindle 42 located therein are generally similar, with the exception of the hex shaped cavity 44, with the spindle and swivel as disclosed by Healey in U.S. patent application Ser. No. 593,373, which has a common assignee with the present application.

The removable cover 30, which is attached to the second end of the cylindrical housing 19 of the body 11 by a plurality of threads (not shown), includes a hexagonal cavity 32 located coaxially therein. The hexagonal cavity 32 is defined by a plurality of generally planar sides running longitudinally parallel to the longitudinal axis of the cylindrical housing 19. The hexagonal cavity 32 includes an enclosed bottom section (not shown) to prevent dirt, water and other contaminates from communicating through the hexagonal cavity 32 into the cylindrical housing 19 and thereby fouling the internal components therewithin. Of course, the hexagonal cavity could be replaced by a cavity having at least three sides therein.

The impulse arm 12 includes adjacent a second end thereof counterweight means 14 for adding additional mass to the rotational inertia of the impulse arm 12 to increase the period required for the impulse arm to repeatedly engage the stream of water exiting the nozzle 17. The counterweight 14 is separated from the rotational axis of the impuse arm 12 by a substantial distance so that the moment of inertia for the given mass of the counterweight 14 will be increased thereby. The counterweight 14 is generally formed with an increased thickness and mass when compared to the structural design of the other plastic elements used to fabricate the rotary head sprinkler 10.

Figure 2:
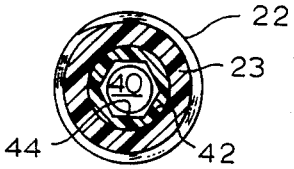
FIG. 2 is a cross-section view illustrating the swivel and spindle means along the section line 2—2 in FIG. 1.

The counterweight 14 includes thereon a plurality of engaging means, wrenches or tools, generally shown as 50. In a first embodiment, as shown in FIG. 1, a first coupling means 51 (or first wrench) is formed from a shaft having a plurality of longitudinally parallel generally planar faces arranged to form a hexagon shaped protrusion (as shown in FIG. 2). The dimensions of the first wrench 51 are designated such that the hexagonal protrusion slidably congruently communicates within the hexagonal shaped cavity 44 of the bore 40 within the spindle 42 of another rotary head sprinkler similar to the one presently being discussed. The coupling of the hexagonal first wrench 51, (which is generally similar to an Allen wrench, with the hexagonal shaped cavity 44, generally similar to an Allen screw or nut, of the spindle 42 allows a torquing force to be exerted upon the impulse arm 12 which will then be communicated through the first wrench 51 and the hexagonal shaped cavity 44 as a rotational force exerted coaxially along the rotational axis of the spindle 42. This rotational torque on the spindle 42 is exerted in such a direction to cause the threaded coupling at the first end of the spindle 42 to disengage or engage, as required, from the sprinkler body 11, as previously explained. The first wrench 51, when coupled to the hexagonal shaped cavity 44, is used to continously rotate the spindle 42 until the first end thereof is disengaged from the body 11, whereupon the spindle 42 may be removed from within the bore of the swivel 23. This operation will expose the sealing and wearing washers and any other serviceable or replaceable items attached to the lower bearing seal of the rotary head sprinkler 10.

This design of the first wrench 51 and the hexagonal shaped cavity 44 into which it couples allows the lower end of the spindle 42 to be reduced in longitudinal length for enlarging the clearance between the spindle 42 and the mouth of the standpipe 24, thereby decreasing the probability that mud and other particulate contaminates will accumulate to restrict the rotation of the spindle within the mouth of the standpipe 24.

The first wrench 51 may be designed to also couple with the hexagonal cavity 32 contained within the removable cover 30. However, due to the size of the hexagonal shaped cavity 44 and the torque required to be exerted thereupon, it is preferable that the dimensions of the first coupling wrench 51 and the hexagonal shaped cavity 44 be as large as possible, within the size and strength restraints imposed by the plastic material of which these elements are made. Given these restraints, it will be easier to designate and design a second wrench 52, having overall generally smaller dimensions than the first wrench 51, for coupling with generally smaller hexagonal cavities, such as the hexagonal cavity 32. While the term "wrench" has been used herein to designate an Allen type wrench, the term should not be limited to this particular embodiment. Instead, the term wrench is intended to include all torque coupling devices.

Figure 3:
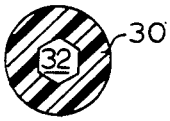
FIG. 3 is a cross-section view of the removable cover removably attached to the sprinkler body taken along the section lines 3—3 in FIG. 1.

In a first preferred embodiment, the second wrench 52 is mounted coaxially with the first wrench 51 on the opposing side of the counterweight 14. The second wrench 52 is generally formed of six longitudinally parallel generally planar sides having the general shape of a hexagon. The dimensions of the planar sides are designed to congruently couple with the generally planar sides defining the hexagonal cavity 32 within the removable cover 30 of another generally similar rotatable step-by-step sprinkler head 10 of similar design. When a rotational force is exerted upon the impulse arm 12 it is communicated through the second wrench 52, through the hexagonal cavity 32 and into the removable cover 30, thereby rotating the removable cover 30 in a direction allowing the removal or attachment of the cover 30 to the threaded end of the cylindrical housing 19. The dimensions of the second wrench 52 are generally described by the cross-section of the removable cover 30 and the hexagonal cavity 32 therein as shown in FIG. 3.

The mass of the first wrench 51 and the second wrench 52 provide an increase in the rotational inertia of the counter weight 14 as the impulse arm 12 rotates about its central pivot axis. This additional mass is useful in increasing the period of oscillation for the impulse arm while also providing a self-contained tool which can be utilized for facilitating the assembly or disassembly of a similar rotary head sprinkler. The hexagonal Allen wrench shape assumed by the first wrench 51 and the second wrench 52 provide an optimum utilization of the strength characteristics of the plastic compound utilized in the manufacture of the impulse arm 12 and the rotatable sprinkler head 10. The plastic material exhibits high compression strength and if a good sliding fit is designed between the hexagonal wrenches 51 and 52 and the hexagonal cavities 44 and 32, then the tools will be useful for a considerable period of time without exhibiting significant wear or damage to the generally planar surfaces thereon. While a six sided hexagon shaped Allen wrench and nut have been illustrated in the first embodiment hereof, it should be obvious to one skilled in the art that a wrench and nut with two or more sides could be utilized with generally equivalent results. However, a two sided wrench, when molded of plastic, has been shown to be subject to fatigue fractures and disengagement from the body of the sprinkler. Therefore, a shaft having at least three generally parallel sides thereon is to be preferred, with six sides being close to optimum.

It should be apparent at this point that a new and useful combination rotary head sprinkler and self-contained tool has been described as a first preferred embodiment which is merely an example of the invention as claimed. However, the present invention should not be limited in its application to the construction details and the parts illustrated in the accompanying drawings since this invention may be practiced or constructed in a variety of other different embodiments. Also, it must be understood that the terminology and descriptions employed herein are used solely for the purpose of describing the preferred embodiment and should not be construed as limitations on the operability of the invention.

I claim:

1. An improved rotary head sprinkler apparatus having a self-contained tool attached thereto, said sprinkler apparatus being of the type having: a sprinkler body, a swivel having a bore therethrough and having attaching means for coupling to a source of water under pressure; a spindle rotatably coupled through said bore of said swivel, said spindle having a cavity communicating therethrough for enabling the flow of said water from said source of water under pressure to said sprinkler body; said spindle having a first end thereof for removably coupling to said sprinkler body; said spindle having a second end thereof for movably coupling with said swivel; a water discharge nozzle attached to said body for discharging a stream of water therethrough; an impulse arm movably coupled to said sprinkler body, said impulse arm having adjacent a first end thereof a water engaging portion for repelling said impulse arm from said stream of water upon engagement therewith; and resilient means coupled between said impulse arm and said sprinkler body for biasing said impulse arm for movement in one direction for engaging said stream of water being discharged by said nozzle, wherein the improvement comprises:

wrench means attached to said sprinkler for coupling with removable portions of another rotary head sprinkler for facilitating the assembly or disassembly thereof, with said wrench means comprising a first wrench attached to said impulse arm of said sprinkler, and wherein said second end of said spindle includes thereon second coupling means for coupling with said first wrench for enabling a rotary force to be exerted on said spindle coaxially with a longitudinal axis thereof, whereby said first end of said spindle may be coupled or decoupled from said sprinkler body.

2. The improved rotary head sprinkler apparatus as described in claim 1 wherein said wrench means is coupled adjacent a distended end of said impulse arm for increasing the mass thereof, whereby the oscillating period of said impulse arm is increased.

3. The improved rotary head sprinkler apparatus as described in claim 1 wherein said first wrench comprises a shaft having a plurality of surfaces thereon, and wherein said second coupling means comprises a continuous portion of said cavity of said spindle defined by a plurality of surfaces for congruently coupling with said surfaces of said shaft when said shaft is inserted therein.

4. The improved rotary head sprinkler apparatus as described in claim 3 wherein said shaft includes at least three generally planar surfaces thereon.

5. The improved rotary head sprinkler apparatus as described in claim 1 wherein another one of said removable portions of said rotary sprinkler head comprises a cover for providing access to internal parts sealed within said sprinkler body.

6. The improved rotary head sprinkler apparatus as described in claim 5 wherein said wrench means includes third coupling means for coupling with fourth coupling means attached to said cover.

7. The improved rotary head sprinkler apparatus as described in claim 6 wherein said third coupling means comprises a second wrench having a plurality of sides thereon, and said fourth coupling means comprises a plurality of sides for defining a chamber therein for congruently coupling with said second wrench when inserted therein.

8. A combination rotary head sprinkler and tool related therewith, said combination comprising:

a rotatable sprinkler body;

a swivel having attaching means for coupling to a source of water under pressure, said swivel having a bore therethrough;

a spindle movably mounted through said bore of said swivel, said spindle having a central cavity communicating therethrough for enabling the flow of water from said source of water under pressure to said sprinkler body, said spindle having a first end thereof for coupling by a plurality of threads to said sprinkler body and a second end thereof for movably coupling with said swivel;

a water discharge nozzle attached to said body for discharging a stream of water therethrough;

an impulse arm movably coupled to said sprinkler body, said impulse arm having adjacent a first end thereof a water engaging portion for repelling said impulse arm from said stream of water upon engagement therewith, said impulse arm having at a second end thereof counterweight means for increasing the oscillating period of the movement of said water engaging portion of said impulse arm engaging said stream of water;

resilient means coupled between said impulse arm and said sprinkler body for biasing said impulse arm for movement in one direction for engaging said stream of water being discharged by said nozzle, whereby said sprinkler head will be moved by the impulse arm intermittently engaging said stream of water; and tool means attached to said counterweight means adjacent said second end of said impulse arm for increasing the mass thereof and for detachably coupling with said second end of said spindle of another similar rotary head sprinkler, thereby enabling a force to be exerted thereon for rotating said spindle, for facilitating the assembly or disassembly of said similar rotary head sprinkler.

9. The combination tool and rotary head sprinkler as described in claim 8 wherein said tool means comprises a first coupling means for coupling with a second coupling means attached to said second end of said spindle.

10. The combination tool and rotary head sprinkler as described in claim 9 wherein said first coupling means comprises a wrench having a plurality of sides, and said second coupling means comprises a nut having a plurality sides for coupling with said wrench.

11. The combination tool and rotary head sprinkler as described in claim 10 wherein said wrench is a multifaced shaft and wherein said nut includes a multifaced cavity therein for congruently receiving therein said multifaced shaft.

12. The combination tool and rotary head sprinkler as described in claim 11 wherein said nut is coaxially attached to said first end of said spindle and said multifaced cavity therein is a continuous portion of said central cavity of said spindle.

13. The combination tool and rotary head sprinkler as described in claim 12 wherein said shaft has a hexagonal cross-section taken perpendicular to a longitudinal axis thereof, and said multifaced cavity has a hexagonal cross-section taken perpendicular to a longitudinal axis thereof.

14. The combination tool and rotary head sprinkler as described in claim 8 wherein said tool means further comprises third coupling means for congruently coupling with fourth coupling means attached to a removable cover, said cover for providing access to removable parts contained within said sprinkler body.

15. The combination tool and rotary head sprinkler as described in claim 14 wherein said removable cover is attached by a plurality of threads to said sprinkler body for providing access to removable parts contained within said sprinkler body.

16. The combination tool and rotary head sprinkler as described in claim 14 wherein said third coupling means comprises another wrench and said fourth coupling means comprises another nut for congruently coupling therewith.

17. The combination tool and rotary head sprinkler as described in claim 16 wherein said tool means comprises said first wrench and said another wrench coaxially spaced on opposite sides of said counter weight means at said second end of said impulse arm.

* * * * *